US010662628B1

(12) United States Patent
Culpepper

(10) Patent No.: US 10,662,628 B1
(45) Date of Patent: May 26, 2020

(54) BATHTUB SPOUT TO PREVENT WATER DAMAGE TO ADJACENT WALL STRUCTURES

(71) Applicant: Arnold Culpepper, Millington, TN (US)

(72) Inventor: Arnold Culpepper, Millington, TN (US)

( * ) Notice: Subject to any disclaimer, the term of this patent is extended or adjusted under 35 U.S.C. 154(b) by 0 days.

(21) Appl. No.: 15/265,835

(22) Filed: Sep. 14, 2016

Related U.S. Application Data

(60) Provisional application No. 62/218,064, filed on Sep. 14, 2015.

(51) Int. Cl.
*E03C 1/04* (2006.01)

(52) U.S. Cl.
CPC ..... *E03C 1/0404* (2013.01); *E03C 1/0408* (2013.01); *E03C 2201/30* (2013.01)

(58) Field of Classification Search
CPC ..... E03C 1/0404; E03C 2201/70
USPC ..... 137/801; 4/675, 678; D23/255–257
See application file for complete search history.

(56) References Cited

U.S. PATENT DOCUMENTS

D198,615 S * 7/1964 Armstrong ..... 74/543
3,801,997 A * 4/1974 Ward ..... B05B 1/1609 137/119.05
D290,161 S * 6/1987 Paul ..... D23/242
5,911,240 A * 6/1999 Kolar ..... E03C 1/04 137/624.11
6,152,180 A * 11/2000 Yang ..... E03C 1/0404 137/119.05
7,269,864 B2 * 9/2007 Brown ..... E03C 1/0401 4/678
2009/0205128 A1 * 8/2009 Jones ..... E03C 1/0404 4/678
2012/0085446 A1 * 4/2012 Lin ..... E03C 1/0404 137/801

(Continued)

FOREIGN PATENT DOCUMENTS

WO WO2014/197903 * 12/2014 ..... E03C 1/0404

OTHER PUBLICATIONS

"American Standard announces innovative new metal 3D printed faucet designs", 3ders. Jun. 6, 2015. <http://www.3ders.org/articles/20150606-american-standard-announces-innovative-new-metal-3d-printed-faucet-designs.html>.*

*Primary Examiner* — David P Angwin
*Assistant Examiner* — Nicholas A Ros
(74) *Attorney, Agent, or Firm* — William S. Parks

(57) ABSTRACT

A bathtub spout article that allows for aesthetic and functional capacity while simultaneously effectively preventing collected and adhered water from migrating to an adjacent wall structure is provided. Such a spout includes a standard connection (screw-type, for instance) to a dispensing water pipe extending from such a wall structure with an opening for water egress purposes as well as a migration-prevention opening (or gutter) on the underside thereof. Such an opening (or gutter) directs any migrating water from the spout opening from transporting past such an underside opening (or gutter) thereby preventing all such potentially migrating water from reaching the wall structure from which the pipe and spout extend. In this manner, the water will simply collect at the edge of such an opening (or gutter) and drip into the subject shower basin, preventing any water damage from occurring at the wall structure location.

8 Claims, 3 Drawing Sheets

(56) References Cited

U.S. PATENT DOCUMENTS

2013/0291977 A1* 11/2013 Chung ..... E03C 1/0404
137/801
2016/0069051 A1* 3/2016 McHale ..... E03C 1/0404
137/597

* cited by examiner

BATHTUB SPOUT TO PREVENT WATER DAMAGE TO ADJACENT WALL STRUCTURES

CROSS-REFERENCE TO RELATED APPLICATION

This application claims priority of U.S. Provisional Patent 62/218,064, filed on Sep. 14, 2015, the entirety thereof such application being incorporated herein by reference.

FIELD OF THE INVENTION

The present invention relates to a shower spout article that allows for aesthetic and functional capacity while simultaneously effectively preventing collected and adhered water from migrating to an adjacent wall structure. Such a spout includes a standard connection (screw-type, for instance) to a dispensing water pipe extending from such a wall structure with an opening for water egress purposes as well as a migration-prevention opening or gutter on the underside thereof. Such an opening or gutter directs any migrating water from the spout opening from transporting past such an underside opening or gutter thereby preventing all such potentially migrating water from reaching the wall structure from which the pipe and spout extend. In this manner, the water will simply collect at the edge of such an opening or gutter and drip into the subject shower basin, preventing any water damage from occurring at the wall structure location.

BACKGROUND OF THE PRIOR ART

Showers and bathtubs (sometimes both) are standard implements within homes. The ability to simply access water sources for bathing purposes has certainly been an area that has shown innovations over many years; however, one long-known problem homeowners face is the repetitive, continuous, and destructive flow of water within such confines, even when such water flow appears to be limited, if not hard to see. For instance, typical water spout structures utilized within this shower/bathtub industry includes the provision of a water line from an external source (municipal source, well, etc., as examples) that is placed within the internal portions of walls and including an extending pipe into the bathtub/shower. Such a pipe is generally aligned parallel to the floor of the bathtub/shower. As the utilization of this pipe alone is not aesthetically acceptable, there are provided water spout cover articles that screw (or otherwise connect) to such a pipe with an end that buttresses the wall from which the pipe extends (thus covering up any unsightly view thereof), encompasses the entirety of such a pipe and includes, at the opposing end, a directional opening (typically, though not necessarily square-like in shape) to allow for water leaving the extended pipe downward into the bathtub/shower, thus including a curved top portion bending downward as well. In some circumstances, the spout includes a flow diverter to allow the water to egress from an upper shower spout through a simple lift or toggle operation.

In either situation, such downward flowing spout pipe cover articles suffer from a distinct problem in that the water flowing from such a spout article will exhibit, through cohesion with other water molecules and adhesion with the surface structures of the spout materials themselves, water migration along the lip of the spout and along the underside thereof. Such migrating water, though not much, possibly, during individual uses of such a bathtub/shower, will continuously and repetitively transport along the underside of the spout article until it reaches the wall structure from which the pipe extends and the spout article itself buttresses. The ability of such water then to migrate within the pipe opening and within the wall structure causes a significant problem through the damaging and uncontrolled continuous exposure to moisture at such locations. Even with a small amount of water potentially migrating after each use, over time the internal damage, whether through erosion, mold growth, wood damage, providing a source for pest infestation, etc., there are significant issues that have yet to be easily addressed. Fixes after such damage has occurred are costly; prevention mechanisms may include seals at certain openings within a wall structure, but those wear away over time, as well, even if they prove somewhat effective initially. In terms of any improvements for avoidance of such problems at the shower spout article level, nothing has been proposed to date that averts such a water migration concern. As such, no simple suggestions for improvements in this area have been provided within the shower spout industry.

Advantages and Summary of the Invention

One distinct advantage of the present disclosure is the ability to prevent water migration from the spout opening to the adjacent wall structure through the presence of a cut-out, or possibly just a gutter or groove, along the underside of the spout article. Another advantage is the ability to provide such an opening or gutter that does not compromise the usefulness and functionality of the shower spout article. Additionally, the shower spout article may include any type of cut-out (opening) or gutter or groove, providing, if desired, certain shapes, designs, and the like, for the shower spout, as long as such a cut-out opening (or possible gutter or groove) is properly provided to cause any migrating water to drip therefrom and not migrate further such a point on the spout article underside.

Accordingly, this invention encompasses a shower spout article configured to cover and connect with a water pipe extending from within an adjacent wall structure, said shower spout article comprising a connection component for attachment with said water pipe, a wall buttressing end, an opposing spout opening end, a top side, an underside, two adjacent lateral sides, and, optionally, a diverter valve present on the top side thereof, wherein said shower spout article includes a cavity housing said connection component for attachment with said water pipe, wherein said spout opening end includes a directional opening for egress of water from said water pipe and an edge around said opening, and wherein said underside of said shower spout article includes at least one water migration prevention cut-out opening therein such that there is no direct path on said underside for water to migrate from said spout opening edge to said wall buttressing end. The method of utilizing such a shower spout article to prevent water migration from said spout opening edge to an adjacent wall structure from which said water pipe extends and to which said shower spout article is adjacent to with is also encompassed herein.

Such shower spout articles are typically provided with the same basic structure of a wall buttressing end and an opposing spout opening end, as well as a possible shower water source diverter valve, or similar structure. Additionally, the cavity housing the water pipe connection (and thus receiving the water pipe itself during utilization), are standard within such shower spout articles, too. There is nothing, however, provided within this art or industry that provides such a cut-out for water migration prevention purposes. Such a cut-out, if a clear removal of material in the underside structure, does not allow water to flow therethrough during utilization, it is present for the ability to prevent such residual water from migrating from the spout opening edge along the spout article underside to the adjacent wall structure. The cut-out may be of any design or configuration as long as such an opening (removal of all material in the specific region the cut-out or cut-outs is/are present) prevents a pathway for water migration from spout opening to wall buttressing end. With the propensity of such water molecules to follow the path of least resistance, coupled with water cohesion and adhesion to the spout underside surface, the ability to disrupt such a pathway leads to the water to stop any such migration at the edge of such a cut-out (or cut-outs) and merely drip into the subject bathtub/shower basin instead.

The shower spout article may be manufactured from any typical material, including stainless steel, brass, metal-plated steel (whether chrome, brass, gold, and the like), and even, if desired, certain hard and resilient plastics (polyacrylates, as one example). The cut-out opening may be included within a mold (as such metal structures may be produced in a foundry or like location) or may be incorporated subsequent to manufacture through a die-cutting method (or any other like procedure). As noted above, the cut-out opening (or openings) may be of any type and configuration as long as the water pathway is disrupted sufficiently. As well, the cut-out opening should not compromise the structural and dimensional stability of the shower spout article itself (in other words, such a cut-out or cut-outs should not cause any appreciable reduction in strength and stability of the article itself during utilization). The removal of a certain amount of material within the article underside thus may be of any amount that allows for the utilization of the shower spout article in this manner. For aesthetic purposes, such a cut-out or cut-outs are preferably limited to placement on the underside portion of the shower spout article (as openings on the lateral portions or even top side would be unsightly and questionable from a commercial standpoint); as well, however, excessive openings could, as noted above, compromise the overall strength and stability of the shower spout article itself. As the needed amount and configuration of any openings on the underside should be minimal as long as the functional aspects of water migration prevention are provided, such a cut-out opening (or openings) should likewise be limited in size and shape. A straight line across the underside running parallel with the wall buttressing end from one side of the underside to the other would be suitable, for instance, having a ¼ to 1 centimeter width. An arced opening may also be provided from one side to another for the underside, running in a similar direction with the aforementioned straight line and having a similar width range. Such a cut-out configuration may be provided as specific designs (such as logos, letters, and the like, if desired, as well, as long as such openings present therein meet the above-noted requirements of preventing a water migration pathway on the shower spout article underside and not creating any appreciable stability and/or strength issues within the entirety of the shower spout article itself.

The shower spout article may include, as alluded to above, a diverter valve (lift, toggle, and the like) present on the top side portion thereof for water flow control purposes (to a shower spigot, for instance). The spout opening, as well, may be provided in a configuration that directs water from the connected extended water pipe downwardly into the subject bathtub/shower when in operation. Such a downward angle may be of any suitable measure for such a purpose and one of ordinary skill within this art would easily deduce such a concern in this situation. The spout opening may be of any geometric or other configuration, as well, from square, to circular, to oval-shaped, and the like. The spout opening will have an edge in relation thereto that has a lip to which water has, as described above, a propensity to adhere (which leads to the migration problems for which this disclosure provides a solution). The extended water pipe to which the shower spout article is connected typically includes a screw-type configuration that is complementary to a receiver component within the internal cavity (pipe housing) of the shower spout article. As noted above, such a connection is typically a screw-type (with typical utilization of TEFLON tape for sealing purposes); however, if desired, any other type of connection may be employed.

In terms of actual utilization, the inventive shower spout article may be provided a user, the user may then attach (screw on, for instance) the shower spout article to an extended water pipe, aligning the wall buttressing end adjacent to the wall structure from which the pipe extends (and may be in contact with or very close thereto such a wall structure). Once in place, the user, or other person, may then activate the water source, divert water to a shower spigot, basically whatever action is desired in relation to the supplied shower spout article and water pipe attached thereto, and then deactivate (turn off) the water source (which may be undertaken through any typical operation, such as turning handles clockwise/counterclockwise, to operate, or any other type of valve provided for operation thereof). The water that collects within the spout opening will still migrate, at least to a certain extent, beyond the edge/lip thereof and along the spout article underside. However, with the water migration prevention cut-out or cut-outs in place, such migrating water will drip downward at the cut-out (or cut-outs) edge closest to the spout opening, preventing any further migration to the wall structure.

DETAILED DESCRIPTION OF THE DRAWINGS

Without any intention of limiting the scope of the inventive device/method, the drawings described herein provide but certain possible embodiments herein. Various modifications and different configurations of such a device/method may be employed without deviating from the scope and basis of the present invention.

Figure 1:
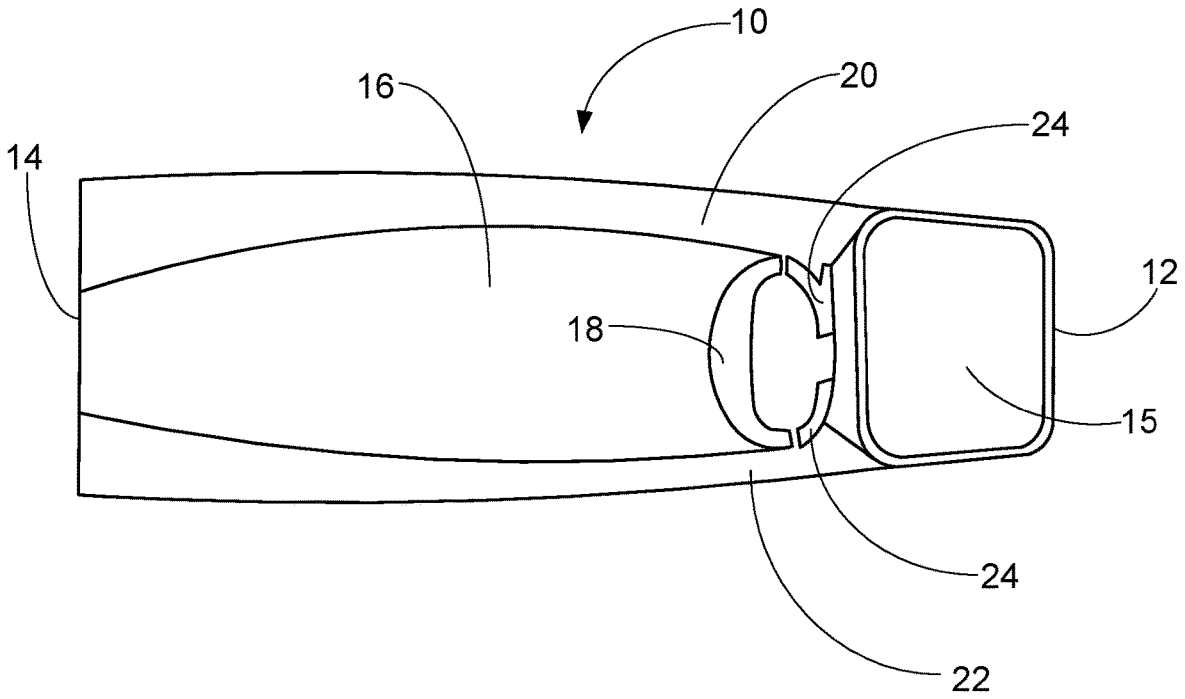
FIG. 1 depicts a bottom perspective view of one possible bathtub spout article embodiment of the disclosure.
Figure 3:
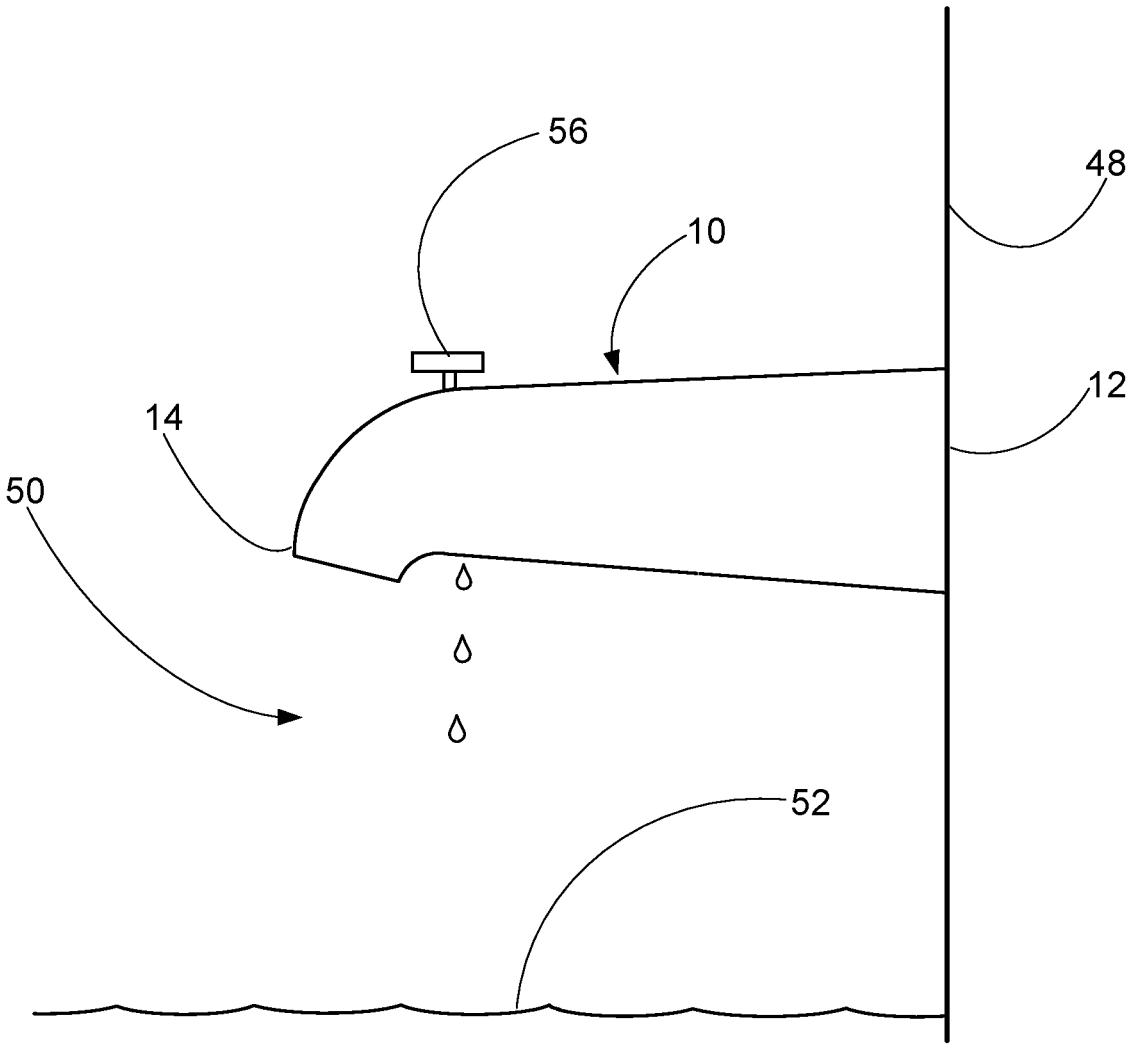
FIG. 3 depicts a perspective view of the bathtub spout article of FIG. 1 installed for use within a shower/bathtub.
Figure 4:
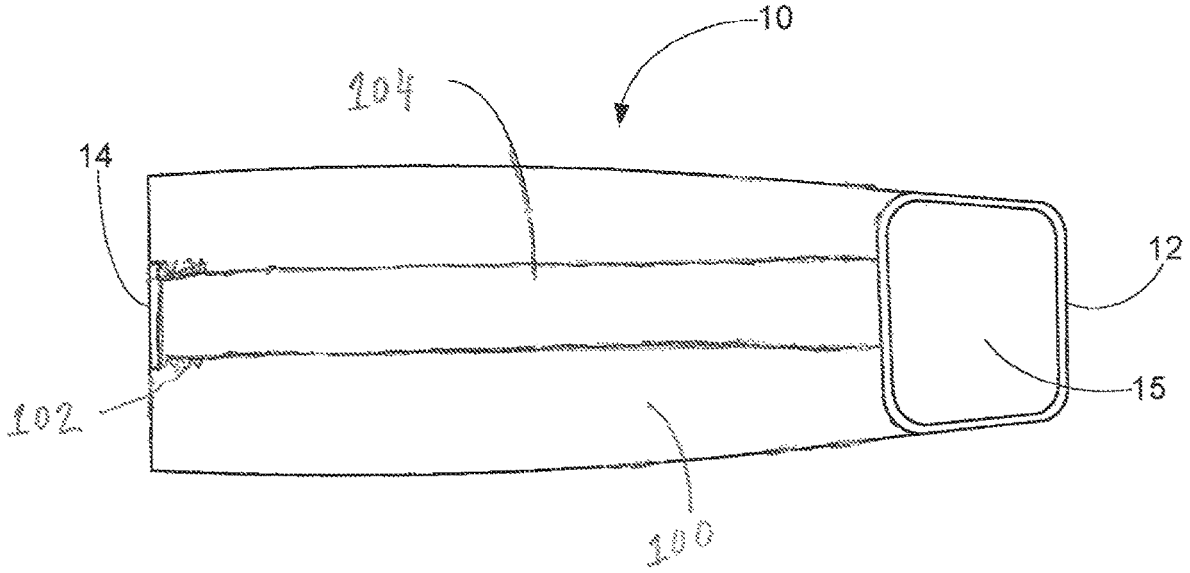
FIG. 4 shows a cross-sectional view of the bathtub spout article of FIG. 1 embodiment of the disclosure.

FIG. 1 and FIG. 4 show a bathtub spout article 10 having a spout opening end 12 (with a spout opening 15), a wall buttressing end 14, and an underside 16, including an arced cut-out 18 leading from one side 20 to another side 22 along the underside 16. Such a bathtub spout article 10 will also include a cavity (100 in FIG. 4) within which is present a connecting means (a receiving screw, for example)(102 in FIG. 4) for a water pipe (104 in FIG. 4) extending from a wall structure (48 in FIG. 3). The arced cut-out 18 also includes other smaller openings 24 nearer the spout opening 15 than the arced cut-out 18 which combined with the arc 18 form a C-shaped structure. The arc 18 is roughly ½ cm in width and creates a barrier to water migration along the underside 16 when in operation within a shower/bathtub and subsequent to discontinuing water activation. The other openings 24 are about ¼ cm in width and they also provide a carrier to water migration, albeit in a different location within the underside 16. The article 10 is made, in this embodiment from chrome-plated stainless steel.

Figure 2:
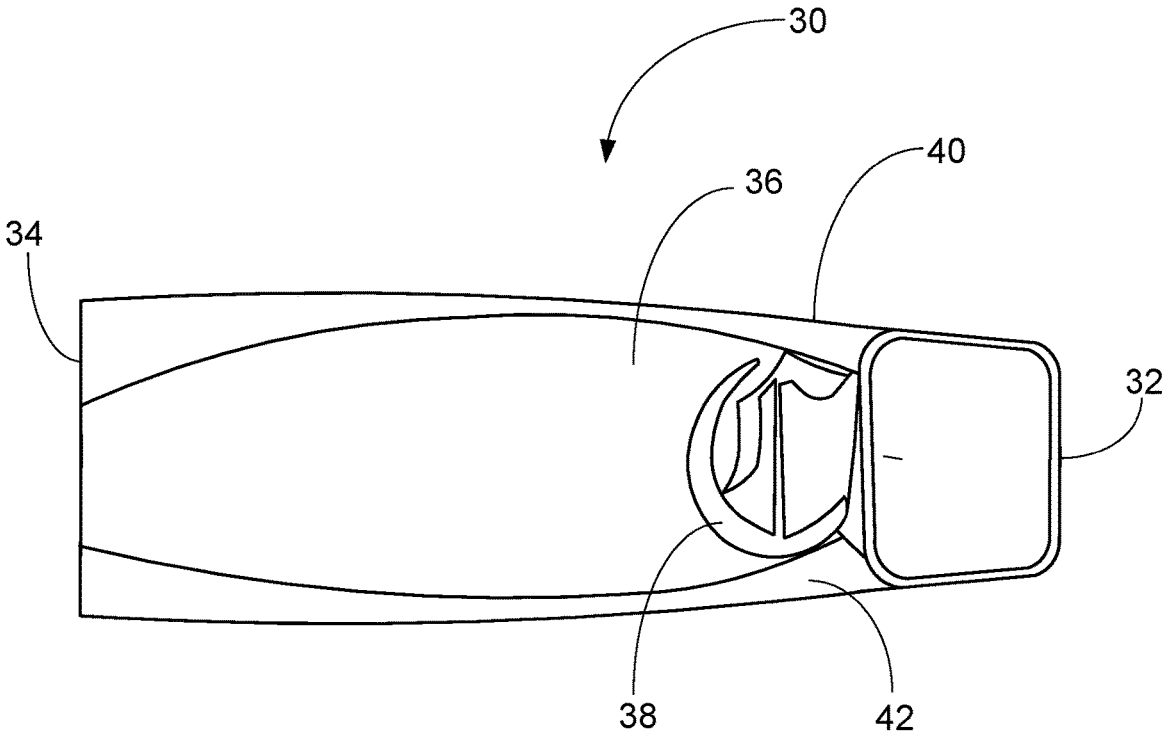
FIG. 2 depicts a bottom perspective view of another possible bathtub spout article embodiment of the disclosure with a different underside cut-out configuration.

FIG. 2 shows a bathtub spout article 30 having a spout opening end 32, a wall buttressing end 34, and an underside 36, including a stylized C-shaped cut-out 38 encompassing various openings that reach from one side 40 to another side 42 along the underside 46. Such a bathtub spout article 30 will also include a cavity (not illustrated, but similar to the same component in FIG. 4) within which is present a connecting means (a receiving screw, for example)(not illustrated, but similar to the same component in FIG. 4) for a water pipe (not illustrated, but similar to the same component in FIG. 4) extending from a wall structure (48 in FIG. 3). The stylized C-shaped cutout 38 has differing measurements for openings thereof, but they range from roughly ¼ cm to 1 cm overall. Such a cut-out 38 creates a barrier to water migration along the underside 36 when in operation within a shower/bathtub and subsequent to discontinuing water activation. The article 30 is manufactured, in this embodiment, from brass-plated stainless steel.

FIG. 3 thus shows the bathtub spout article of FIG. 1 10 attached to a water pipe (not illustrated, but similar to the same component in FIG. 4) extending from a wall structure 48 in relation to a subject bathtub/shower 50 (and including a diverter valve 56). The wall buttressing end 12 is adjacent to such a wall structure 48 and the spout opening 14 extends over the bathtub/shower basin 52 to allow for water to egress from the pipe (not illustrated, but similar to the same component in FIG. 4) into the basin 52 during activation. Upon deactivation, on demand, the water flow stops, leaving residual water drops, and the like, within the bathtub spout article 10 at the spout opening 14. The presence of the aforementioned cut-out 18 (analogously, the cut-out stylized C of FIG. 2, 38) prevents such water migrating from the spout opening 14 to the wall structure 48. As described above, this shower spout article 10 (30 in FIG. 2) provides a suitable and reliable manner of preventing continuous water migration in this manner, saving such a wall structure 48 from continuous damaging exposure to such moisture. Over time, significant repair, mold abatement, and other costs are thus avoided through the utilization of this innovative article.

Having described the invention in detail it is obvious that one skilled in the art will be able to make variations and modifications thereto without departing from the scope of the present invention. Accordingly, the scope of the present invention should be determined only by the claims appended hereto.

What I claim is:

1. A bathtub spout article configured to cover and connect with a water pipe extending from within an adjacent wall structure, said bathtub spout article comprising a connection component for attachment with said water pipe, a wall buttressing end, an opposing spout opening end, a top side, an underside, and two adjacent lateral sides, wherein said spout article includes a cavity housing said connection component for attachment with said water pipe, wherein said water pipe extends within said cavity from said wall structure to said spout opening end upon installation, wherein said spout opening end includes a directional opening for egress of water from said water pipe and an edge around said opening, and wherein said underside of said bathtub spout article includes at least one water migration prevention cut-out opening therein from one lateral side thereof to the other such that there is no direct path on said underside for water to migrate from said spout opening edge to said wall buttressing end, wherein said at least one cut-out opening has no spout material present therein; and wherein water does not exit from said cut-out opening from within said spout article cavity during utilization thereof.

2. The article of claim 1 wherein said article is manufactured from materials selected from the group consisting of stainless steel, metal-plated steel, brass, metal-plated stainless steel, and plastic.

3. The article of claim 2 wherein said article is manufactured from metal-plated stainless steel.

4. The article of claim 1 wherein said article further includes a diverter valve present on the top side thereof.

5. A method of providing a water source into a bathtub/shower basin utilizing the article of claim 1.

6. A method of providing a water source into a bathtub/shower basin utilizing the article of claim 2.

7. A method of providing a water source into a bathtub/shower basin utilizing the article of claim 3.

8. A method of providing a water source into a bathtub/shower basin utilizing the article of claim 4.

* * * * *